United States Patent [19]

Virte et al.

[11] 4,343,405

[45] Aug. 10, 1982

[54] UNIVERSAL MOUNTABLE DISPLAY TRAY

[75] Inventors: Jean Virte, Domont; Laurent Costa, Ville D'Avray, both of France

[73] Assignee: Union Carbide Corporation, New York, N.Y.

[21] Appl. No.: 134,638

[22] Filed: Mar. 27, 1980

[51] Int. Cl.[3] ..... B01D 35/00; B01D 35/14

[52] U.S. Cl. ..... 211/88; 211/106

[58] Field of Search ..... 211/88, 106; 248/214, 248/215, 220.3, 220.4, 221.1, 221.2; 108/47, 152

[56] References Cited

U.S. PATENT DOCUMENTS

| | | | |
|---|---|---|---|
| 754,858 | 3/1904 | Edison . | |
| 856,593 | 6/1907 | Lee . | |
| 1,255,444 | 2/1918 | Leon et al. . | |
| 1,339,018 | 5/1920 | Boyce | 248/214 X |
| 1,703,987 | 3/1929 | Butler . | |
| 1,758,098 | 5/1930 | Williams . | |
| 1,921,462 | 8/1933 | Graham . | |
| 2,002,328 | 5/1935 | Mitchell | 211/88 |
| 2,812,852 | 11/1957 | Samuels | 211/88 |
| 2,831,598 | 4/1958 | Slavsky et al. | 211/88 |
| 2,932,544 | 4/1960 | Lambert . | |
| 3,089,597 | 5/1963 | Kaplan . | |
| 3,161,295 | 12/1964 | Chesley . | |
| 3,167,287 | 1/1965 | Collins | 211/106 |
| 3,265,246 | 8/1966 | Messenger . | |
| 3,854,588 | 12/1974 | Kinard | 211/106 |
| 3,986,649 | 10/1976 | Heimstra . | |
| 4,027,799 | 6/1977 | Stucker . | |
| 4,240,549 | 12/1980 | Hogg | 211/106 |

*Primary Examiner*—Francis K. Zugel

*Attorney, Agent, or Firm*—Cornelius F. O'Brien

[57] ABSTRACT

A display tray for consumer type articles having a plurality of pivotable support means for securing the tray on various width slats and various "peg-board" type support walls, and also having horizontal brace support means for maintaining the tray in a horizontal position.

7 Claims, 7 Drawing Figures

UNIVERSAL MOUNTABLE DISPLAY TRAY

FIELD OF THE INVENTION

This invention relates to a universal mountable merchandise display tray for displaying merchandise, such as free-standing articles, for example, batteries.

BACKGROUND OF THE INVENTION

Display trays for consumer goods have recently become an important merchandise tool. They permit the handling and transfer of a plurality of small articles to be placed on display in a minimum of time whereupon the articles can then be easily removed one at a time by a consumer without disturbing the remaining articles. Display trays also provide for maximum packing and display of articles that make them easily accessible to the consumer. Some display trays are designed to be supported on horizontal supports, such as counter tops, while others are designed to be supported on walls, horizontal slats, "peg-board" type supports, etc. The difficulty in providing display trays is that they are generally suited for only one type of mounting. This greatly restricts the versatility of the display tray and necessitates the supplier to stock and ship numerous types of display trays to retailers to accommodate their various display counters. Typical of the type of display trays which have been proposed are shown in U.S. Pat. Nos. 754,858; 856,593; 1,255,444; 1,703,987; 1,759,098; 3,089,597; 3,161,295; 3,265,246; 3,734,279; 3,986,649 and 4,027,799. Each of these trays is designed to mount primarily in only one form. Most of the consumer-type trays provide a means for not only displaying articles but make the articles accessible and visible for the consumer. Modern retail establishments are demanding self-serve type display trays that are easy to stock and which permit easy removal of the article by a customer while at the same time displaying the next article to be sold in an orderly and aligned manner.

It is an object of the present invention to provide a universal mountable display tray for freestanding merchandise.

Another object of the present invention is to provide a display tray that can be mounted on various width slats, peg-board type materials or on a horizontal surface.

Another object of the present invention is to provide a display tray with movable screw means for backing the tray against a vertical support member so as to maintain the display in a horizontal plane.

Another object of the present invention is to provide a universal mountable display tray having a front wall having a flat surface adapted for securing and displaying indicia regarding the merchandise contained on the display tray.

The foregoing and additional objects will become more fully apparent from the following description and the accompanying drawings.

SUMMARY OF THE INVENTION

The invention relates to a universal mountable merchandise display tray comprising a trough-like receptacle for containing a plurality of items of merchandise, said receptacle comprising a bottom wall; a pair of side walls; a front wall and a rear wall, said rear wall comprising two spaced-apart rod members each extending from one of the side walls and terminating with rearwardly inverted U-shaped members adapted for securing on a support member; at least one support bar extending across and secured to the two spaced-apart rear wall rod members; a plurality of first rod members pivotally secured on one support bar and terminating in inwardly U-shaped segments which when pivoted to an upright position provide rearwardly inverted U-shaped segments for securing on a support member; a plurality of second rod members pivotally secured on one support bar and each comprising a downward vertical segment extending with an inwardly horizontal segment and terminating in a downward vertical segment such that when pivoted towards an upright position, each terminal segment is adapted to be fed in an aperture of a wall support member until vertically oriented whereupon the display tray becomes secured to the wall support member.

In the preferred embodiment of the invention, a second support bar extends across and is secured to the spaced apart rear wall rod members and disposed above the support bar containing the pivotable first rod members and above the support bar containing the pivotable second rod member so as to limit the pivoting of these rod members to an upright vertical position. In addition, a rearwardly support bracket could be secured to the two spaced-apart rear wall rod members and contain at least one horizontal longitudinal movable screw means coupled to a relative flat support element that is disposed rearward of the support bracket so that the support element can be horizontally moved to abut a vertical support structure thereby firmly securing the display tray in a horizontal position.

An additional embodiment of the display tray will entail the front wall having a flat surface adapted for securing and displaying indica regarding the merchandise contained on the display tray.

The display tray for use in this invention can be made from steel, iron, plastic or any other suitable rigid material. The height of the side and front walls can vary so as to securely contain free standing merchandise, such as packages of batteries or to securely contain tray-loaded merchandise in which the merchandise is shipped and packaged with the trays. A typical example of this would be the battery-loaded trays disclosed in U.S. Pat. No. 3,734,279.

The cross section of the rod members for use in this invention could be circular, rectangular, oval or any polygon configuration.

The present invention will become apparent from the following description thereof when considered together with the accompanying drawings which are set forth as being exemplary of embodiments of the present invention and not intended, in any way, to be limitative thereof and wherein.

Figure 1:
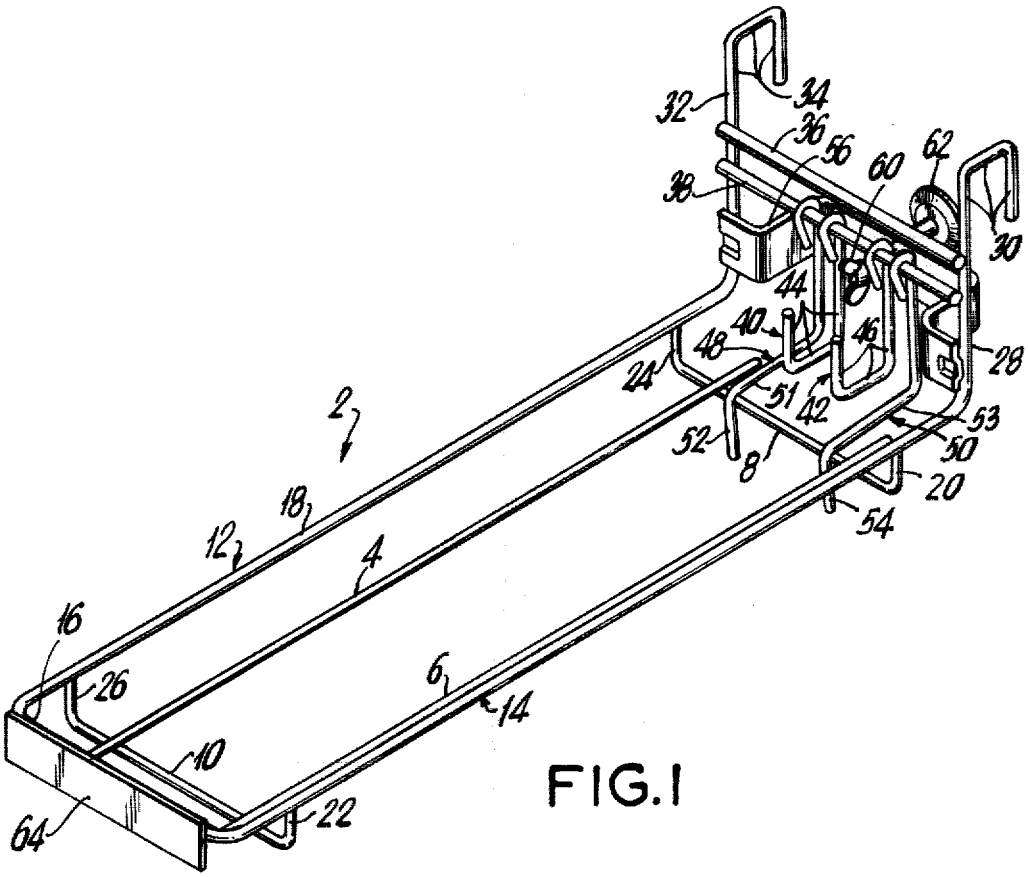
FIG. 1 is a perspective view of a display tray in accordance with the invention.
Figure 2:
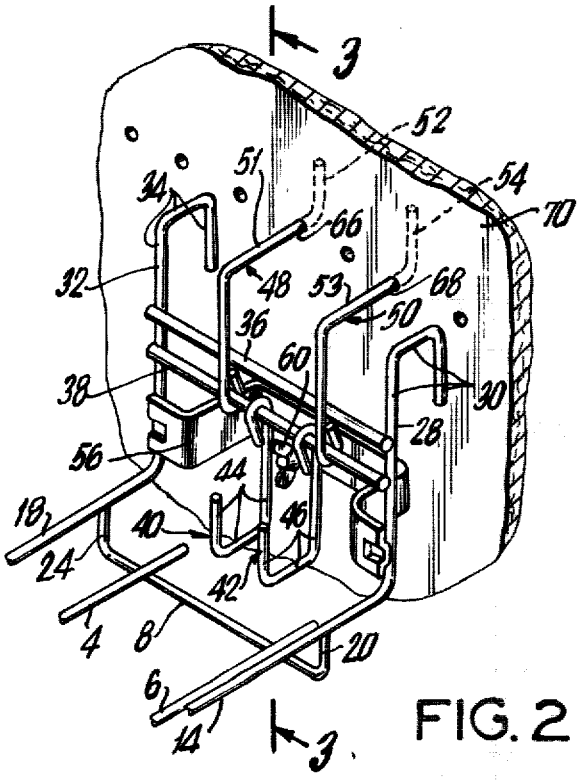
FIG. 2 is a perspective view of the rear portion of the display tray of FIG. 1 mounted on a peg-board.

Referring in detail to FIG. 1, there is shown a display tray 2 comprising a bottom wall composed of two longitudinal rods 4 and 6, secured at proximal the rear end by an extended U-shaped brace 8 and secured proximal the front end by an extended U-shaped brace 10. The side and front walls of the display tray comprise a continuous rod member 12 which has a longitudinal segment 14 forming a first side wall, a transversal segment 16 forming a front wall, and a second longitudinal segment 18 forming a second side wall. Longitudinal segment 14 is secured to the end of legs 20 and 22 of extended U-shaped braces 8 and 10, respectively, and longitudinal segment 18 is secured to the end of legs 24 and 26 of extended U-shaped braces 8 and 10, respectively.

The rear portion of rod member 12 of the first side wall (14) extends upwardly forming a vertical segment 28 terminating in an inverted U-shaped configuration 30. The rear portion of rod member 12 of the second side wall (18) extends upwardly forming a vertical segment 32 terminating in an inverted U-shaped configuration 34. Secured to segments 28 and 32 are traverse support bars 36 and 38. Mounted on support bar 38 are a pair of pivotable hook-type members 40 and 42 which in the free standing position terminate with inwardly disposed U-shaped segments 44 and 46, respectively. Straddling hook-type members 40 and 42 and mounted on support bar 38 are a pair of pivotable peg-board type members 48 and 50, each of which in the free standing position terminates with downward vertical disposed peg segments 52 and 54, respectively.

An extended U-shaped support bracket 56 oriented 90° counter clockwise is secured to segments 28 and 32 of the rear wall of the display tray. Centrally disposed on support bracket 56 is a threaded opening 58 (FIGS. 3, 5 and 7) which accommodates wing nut screw member 60 having secured on its terminal end a relatively flat disc 62, said disc disposed rearward of support bracket 56. Secured to the front wall (16) of the display tray 2 is a flat rectangular slat 64 adapted to accommodate indicia identifying the merchandise to be packaged on the display tray. The indicia could be painted on slat 64 or a label containing the indicia could be secured on slat 64 using any conventional means.

FIGS. 2 through 7 demonstrate the operation of the display tray 2 of FIG. 1 and identical parts have been identified with the same numerical numbers as appear in FIG. 1.

Figure 3:
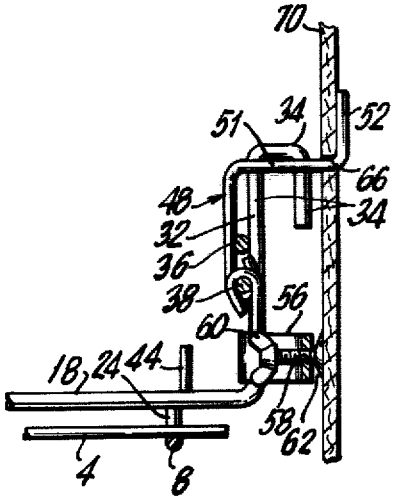
FIG. 3 is a side view of the rear portion of the display tray of FIG. 2 taken through line 3—3.
Figure 4:
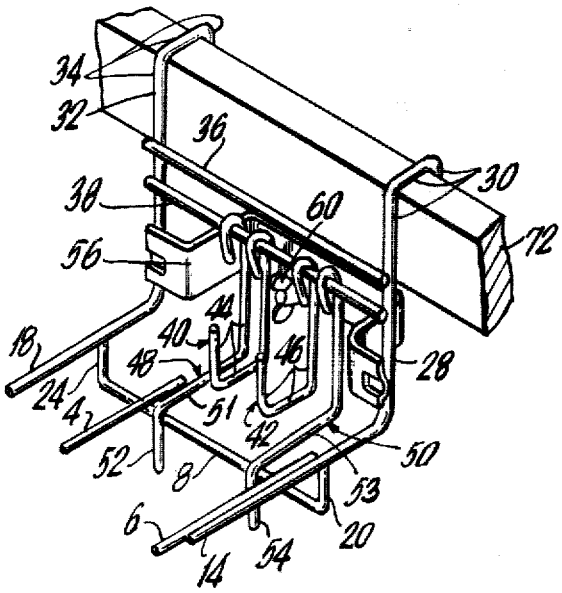
FIG. 4 is a perspective view of the rear portion of the display tray of FIG. 1 mounted on a support slat.

In FIGS. 3 and 4, pivotable peg-board members 48 and 50 are shown pivoted to an upright position whereupon the peg segments 52 and 54 are positioned through openings 66 and 68 defined in peg-board 70 and vertically aligned thereby securing display tray 2 to peg-board 70. As shown in FIG. 3, wing-nut screw means 60 is rearwardly advanced to position disc 62 against peg-board 70 thereby firmly securing display tray 2 in a substantial horizontal position. As evident from FIGS. 2 and 3, the width of inverted U-shaped members 30 and 34 is smaller than the length of the horizontal segments 51 and 53 of pivotable peg-board members 48 and 50, respectively, so as to insure that the members 30 and 34 will not interfere with the mounting of display tray 2 on peg-board 70. As also evident from FIGS. 2 and 3, transverse support bar 36 is disposed above support bar 38 containing pivotable peg-board members 48 and 50 so that the rotation of the pivotable members 48 and 50 can be limited or restricted to an upright position. Thus transverse support bar 36 serves the dual function of being a support for the rear wall and a stopper-type element to limit the rotation of the pivotable members secured on support bar 38.

Figure 5:
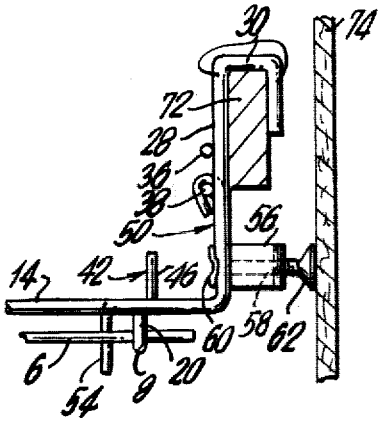
FIG. 5 is a side view of the rear portion of the display tray of FIG. 4.

FIGS. 4 and 5 show inverted U-shaped members 30 and 34 of the rear wall mounted on a support slat 72 which, although not shown, is secured to a main support structure 74. In FIG. 5, the wing-nut screw means 60 is shown extended to the rear whereupon disc 62 forceably abuts support structure 74 thereby firmly securing the display tray 2 in a horizontal position.

Figure 6:
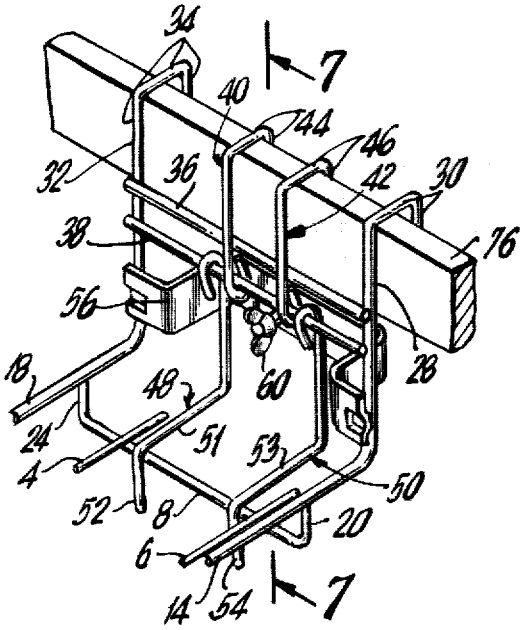
FIG. 6 is a perspective view of the rear portion of the display tray of FIG. 1 mounted on a support slat.
Figure 7:
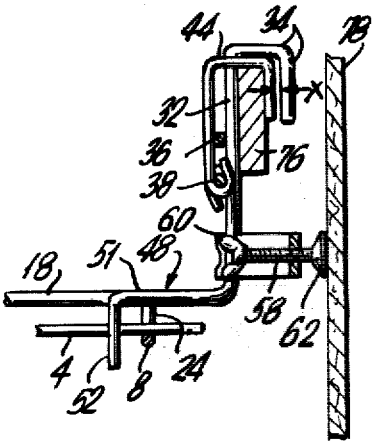
FIG. 7 is a side view of the rear portion of the display tray of FIG. 6 taken through line 6—6.

In FIGS. 6 and 7, pivotable hook-type members 40 and 42 are shown pivoted to an upright position whereupon the U-shaped members 44 and 46, respectively, are secured on a support slat 76 which, although not shown, is secured to a main support structure 78. In FIG. 7, the wing-nut screw means 60 is shown extended to the rear whereupon disc 62 forceably abuts support structure 78 thereby firmly securing the display tray 2 in a horizontal position. As evident from FIGS. 4 through 7, the display tray 2 has the flexibility to be secured on various width slats (73, 76). By adjusting the width of U-shaped members 30 and 34 and the width of U-shaped members 44 and 46, the display tray 2 can be designed for mounting on the most common width slats.

It is also possible to adjust the width of U-shaped members 44 and 46 and the width of U-shaped members 30 and 34 so when the former are oriented in an upright position as shown in FIG. 7, there will be a narrow space X between the rearward legs of U-shaped members 30 and 34 and U-shaped members 44 and 46 to accommodate a narrow width slat onto which the display tray 2 can be mounted. It is also possible to add additional pivotable peg-board members and/or pivotable U-shaped members so as to extend the mounting flexibility of the display tray for various size peg-boards and various width slats.

It should be understood that the foregoing disclosure relates to preferred embodiments of the invention and it is intended to cover all changes and modifications of the invention which do not depart from the spirit and scope of the appended claims.

What is claimed is:

1. A universal mountable merchandise display tray comprising a trough-like receptacle for containing a plurality of items of merchandise, said receptacle comprising a bottom wall; a pair of side walls; a front wall and a rear wall, said rear wall comprising two spaced-apart members each extending from one of the side walls and terminating with rearwardly inverted U-shaped members adapted for securing on a support member; at least one support bar extends across and is secured to the two spaced-apart rear wall members; a plurality of first rod members pivotally secured on one support bar and terminating in inwardly U-shaped segments which when pivoted to an upright position provide rearwardly inverted U-shaped segments for securing on a support member; a plurality of second rod members pivotally secured on one support bar and each comprising a downward vertical segment extending with an inwardly horizontal segment and terminating in a downward vertical segment such that when pivoted towards an upright position, each terminal segment is adapted to be fed in an aperture of a wall support member until vertically oriented whereupon the display tray becomes secured to the wall support member.

2. The universal mountable merchandise display tray of claim 1 wherein a second support bar extends across and is secured to the two spaced-apart rear wall members and disposed above the support bracket containing the pivotable rod members so as to limit the pivoting of said rod members to an upright position.

3. The universal mountable merchandise display tray of claim 1 wherein a support bracket is disposed and secured to the two spaced-apart rear wall members and is provided with horizontal movable screw means projecting through the support bracket and terminating with a relatively flat support element disposed rearward of the support bracket, said screw means adapted for horizontally moving the relatively flat support element to abut a support structure and thereby firmly secure the display tray in a horizontal position.

4. The universal mountable merchandise display tray of claim 1, 2 or 3 wherein there are two first rod members pivotally secured on one support bar.

5. The universal mountable merchandise display tray of claim 1, 2 or 3 wherein there are two second rod members pivotally secured on one support bar.

6. The universal mountable merchandise display tray of claim 1, 2 or 3 wherein there are two first rod members and two second rod members pivotally secured on one support bar.

7. The universal mountable merchandise display tray of claim 1, 2 or 3 wherein a member having a relatively flat surface is secured to the front wall and is adapted for displaying indicia as to the merchandise to be contained on the display tray.

* * * * *